US006206570B1

(12) United States Patent
Cortopassi

(10) Patent No.: US 6,206,570 B1
(45) Date of Patent: Mar. 27, 2001

(54) FLEXIBLE CONTAINER WITH IMPROVED PRINTABLE AND REMOVABLE SECTION

(75) Inventor: Jeffrey J. Cortopassi, Hinsdale, IL (US)

(73) Assignee: Packaging Dynamics, L.L.C., Chicago, IL (US)

( * ) Notice: Subject to any disclaimer, the term of this patent is extended or adjusted under 35 U.S.C. 154(b) by 0 days.

(21) Appl. No.: 09/271,842

(22) Filed: Mar. 18, 1999

(51) Int. Cl.[7] ..... B65D 33/00
(52) U.S. Cl. ..... 383/127; 383/111
(58) Field of Search ..... 383/125, 126, 383/127, 111; 229/70, 305, 302

(56) References Cited

U.S. PATENT DOCUMENTS

| | | | | |
|---|---|---|---|---|
| 174,940 | * | 3/1876 | Brown | 229/305 X |
| 380,616 | * | 4/1888 | Bobrick | 229/70 |
| 392,964 | | 11/1888 | McCulla . | |
| 1,588,875 | | 6/1926 | Curtis . | |
| 2,128,374 | | 8/1938 | Midulla . | |
| 2,129,705 | | 9/1938 | Reineman . | |
| 2,149,872 | | 3/1939 | Schmidt . | |
| 2,226,943 | | 12/1940 | Poppe . | |
| 2,385,647 | | 9/1945 | Poppe . | |
| 2,614,349 | | 10/1952 | Barnes . | |
| 3,183,614 | * | 5/1965 | Loderhouse | 229/70 X |
| 3,227,359 | | 1/1966 | Hanlon . | |
| 3,302,861 | | 2/1967 | Hiersteiner . | |
| 3,804,323 | | 4/1974 | Bemel . | |
| 4,993,845 | | 2/1991 | Faltynek . | |
| 5,025,980 | * | 6/1991 | Blackman | 229/302 |
| 5,163,756 | | 11/1992 | Riseman . | |

FOREIGN PATENT DOCUMENTS

| | | | | |
|---|---|---|---|---|
| 29907 | * | 8/1913 | (GB) | 229/305 |
| 1034170 | | 6/1966 | (GB) . | |
| 2074541 | | 11/1981 | (GB) . | |

* cited by examiner

*Primary Examiner*—Jes F. Pascua
(74) *Attorney, Agent, or Firm*—Fitch, Even, Tabin & Flannery

(57) ABSTRACT

The invention provides a bag container and method for making same with an improved removable section for conveying marketing and promotional messages. The section may be separated from the bag container without compromising the container's integral barrier wall, and provides an improved construction capable of use in high speed, high efficiency, automated handling systems. In addition, the invention provides the option of a bag container and a wrap with a highly secure, tamper resistant, removable section made from a one-piece blank, without the need for additional multi-part security systems or other added security systems.

13 Claims, 4 Drawing Sheets

FLEXIBLE CONTAINER WITH IMPROVED PRINTABLE AND REMOVABLE SECTION

FIELD OF THE INVENTION

The invention relates to flexible containers of barrier materials, such as paper bags and paper wrapping materials, and more specifically to such containers with removable portions or sections.

BACKGROUND OF THE INVENTION

Disposable, flexible containers are widely used in many different applications for holding a wide variety of products. Such containers include bags of various materials and dimensions formed from a web or blank of a barrier material that may be cut, folded or otherwise formed, as well as sealed using adhesives, heat or a combination of such systems.

Some of the most widely used barrier materials are papers, paper composites or other paper-based materials. Such paper-based materials can be formed, treated, laminated or otherwise converted into effective barrier materials useful for containing and holding both dry and liquid products, and products with both liquid and solid characteristics. For the purposes herein, such paper-based barrier materials will be referred to as "paper" materials, which includes various paper products; laminated paper products; and combinations of paper with polymeric materials (such as polypropylenes, polyesters, acetates and polyethylenes), foils, and other non-paper materials.

The compact size, relatively low cost and variety of potential shapes and sizes of paper bag containers provide a great variety of applications for such containers, and certain designs and constructions have become specialized to suit particular end uses. For example, in the food industry, paper bag containers are particularly useful for holding and transporting a wide variety of food products. In one specific example, paper bags are very useful in the transport and sale of pre-cooked and prepared retail foods, such as take out deli foods, chicken products, sandwiches and the like. In some instances, it is desirable to utilize the printable surface of paper bag containers to provide the bags with decorative printed patterns, marketing messages, food preparation instructions and other indicia which enhances the bag containers' utility to end users. In addition, certain printable polymeric materials (such as polypropylenes, polyesters, acetates and polyethylenes) which also can be folded or formed, and sealed with adhesives, heat or other such processes have found utility as barrier materials for similar bag containers in such applications.

One result of the popularity of such bag containers is an emphasis on unique and innovative bag designs for specific uses or purposes. Another result is an increase in the competitiveness of the bag container market. As a result, a premium is placed on cost efficient bag manufacturing processes and products, customer satisfaction with bag containers' performance, and the flexibility of bag products for multiple, general and specialized uses. Moreover, commercially effective paper bag container designs must demonstrate the potential for innovative applications of aesthetic decorations, graphic design, marketing communication and marketing promotion concepts.

Examples of efforts to provide commercially suitable paper bag containers are shown in Riseman, U.S. Pat. No. 5,163,756 (the "Riseman patent"), and the other references mentioned in the Riseman patent, (see Col. 1, lines 11–17). Other examples are shown in the published UK Patent Application, GB 2,074,541 (the "'541 UK Application"), and Faltynek, U.S. Pat. No. 4,993,845 (the "Faltynek patent"). Those references disclose paper bag containers with various forms of tear off or otherwise removable sections that may be printed with promotional, advertising, discount coupons or other such important marketing or sales information. References such as the Riseman and Faltynek patents recognize the advantages of a removable section that does not compromise the containers' barrier wall when it is separated from the bag container.

Aspects of prior designs, however, have one or more features that affect their usefulness in certain applications and for certain specialized purposes. For example, bag container products with partially attached sections, flaps or other readily detachable portions that have free or easily detachable edges may present inefficiencies when used with high speed automated handling, sorting, insertion or packaging equipment. Such partially attached or readily separable flaps, at times, have the potential to become wrinkled, folded, torn or otherwise damaged in such applications.

The partially attached or readily separable flaps, at times, have the potential to cause equipment jams or other stoppages or inefficiencies in automated, high speed handling equipment. Attempts to apply adhesives in small, defined areas of a bag to tack down and temporarily hold flap-like removable sections, such as disclosed in the '541 UK Application, have not adequately eliminated such concerns. Such tacked down flap-like sections are susceptible to inadvertent opening, and in certain applications may not ensure sufficient restraint of the flap-like sections for use in high speed, handling and dispensing equipment.

A bag container construction that improves on prior designs with removable sections to reduce or eliminate the potential for such difficulties and inefficiencies, also provides an opportunity to obtain significant cost savings and a broader application of bag container, particularly in automated handling systems. In addition, a bag container that employs a removable section that is secured from inadvertent, unauthorized and accidental disclosure of printed indicia on, behind or under the removable section provides the opportunity to use such bags in new marketing and promotional applications where such bags previously have not been used.

In such marketing and promotional applications, it is often important to ensure that the printed indicia is only revealed at an appropriate time, such as at a retail store, before authorized representatives, or before or at time of purchase of products or services. In other applications, there must be some manner of identifying products that have been subject to tampering before or during the distribution process, i.e., before the products are received by the intended users. Bag containers such as those disclosed in the '541 UK Application with removable sections that are not secured or are only partially secured are unsuitable for such purposes.

Examples of such marketing and promotional uses include certain contests and discount marketing promotion programs, where playing pieces are distributed with a concealed message concerning a prize, a discount or further contest information. In prior efforts, multi-part paper tokens or playing pieces were commonly used for such efforts. The token or playing piece typically included an opaque upper paperboard or paper layer laminated to a lower printed layer carrying the contest or discount message. The upper layer was provided with perforations and was removed from the token along the perforations to reveal the underlying message on the bottom layer at an appropriate time.

In another example, a card section, paper section or other surface was coated with an opaque coating, typically a waxy ink or paint to conceal a message under the coating. The surface of the coating was then rubbed or scratched to remove the coating and to reveal the underlying message. Such coated products, however, have limited application to bag containers and involve additional expenses for the preparation of the surface and coated product. Those systems also tended to have an unattractive appearance and thus would not be accepted for certain applications due to aesthetic and marketing concerns. Such coatings also could be difficult to remove and were susceptible to inadvertent damage which resulted in disqualification of the playing piece. Thus, such multi-layer and coated playing pieces were rendered undesirable for certain marketing applications.

The invention provides an improved bag container construction and method utilizing an improved removable section suitable for use in a variety of applications. This includes use with high speed automated handling equipment and other applications where flaps, partially attached sections, and removable sections with exposed or free edges are undesirable. In addition, the bag container construction and method of the invention is adaptable for use in marketing efforts, promotional efforts or other applications where it is desirable or necessary to provide a hidden, obscured or otherwise fully or partially concealed message or design section with a removable cover or overlying sections. Such applications may include instances it is desirable to provide labels commonly used for promotions with a protective cover. In such applications, that protective cover also may be printed with further promotional or advertising indicia.

The method of the invention is usable with a variety of barrier materials including paper, treated paper, paper composites, paper-foiled laminates, certain polymeric barrier materials, and multi-ply barrier materials of a variety of compositions. The method permits the utilization of multiple printable surfaces to maximize the utility of a removable section without compromising the barrier properties and container properties of the bag construction. Furthermore, opaque ink and coatings can be applied to removable sections "in line" during production of the bag to conceal a marketing or promotional item without a separate step or process.

The invention further provides the option of forming a suitable removable section in a "wrap" or a section of sheet material that can be folded into a container or wrapped around products, including food products. In one aspect, the invention provides a wrap product made of multi-ply wrapping materials of paper, paper laminate, paper composites, certain polymers and other composite materials or other multi-ply wrap materials.

SUMMARY OF THE INVENTION

The invention provides a bag container with an improved removable section that is not only particularly well suited for conveying marketing and promotional messages, but further provides an improved integral construction to permit its use in high speed, high efficiency automated systems. In addition, unlike previous bag containers with such separable sections, the invention provides the option of a bag container with a highly secure, tamper resistant removable section made from a one-piece blank, without the need for additional multi-part security systems or other added security systems, as well as the increased costs for such systems.

The bag container of the invention accordingly extends the potential uses of bags with separable sections which may be removed from the bag container without disrupting the barrier wall of the container. The invention further provides integral bag containers that are suited for use in contests, hidden discounts, surprise promotions or other marketing efforts requiring increased security and temper resistance, in a form that is aesthetically pleasing, flexible in application and cost effective.

In one aspect, the invention provides a container made of flexible, foldable barrier materials. A unitary blank is overfolded to provide the body of the bag container in the form of a predimensioned outer wall with lower peripheral borders folded into a closed bottom section. The upper peripheral borders of the outer wall define the bag opening and are foldable and sealable to close the bag. The overlapping portions of the blank further form a removable section defined by a central seam, a second border seam, and upper edge and a lower edge contiguous with the bag opening and closed end, respectively.

At the central seam and the second border seam, the overlapping blank sections are adhered together and are generally inseparable. In addition, the upper border of the removable section is generally contiguous with the bag opening and typically provides a small unsecured edge allowing sufficient room between the bag body and the removable section for a grippable portion or fingerhold. The remaining peripheral borders are resistant to inadvertent opening, curling, folding or other damage. The removable section also is provided with generally parallel, spaced perforation lines forming a frangible zone contiguous with and adjacent to the center and peripheral seams. As a result the removable section may be grasped at its top by the grippable portion and may be separated from the body of the bag. Moreover, because the removable section overlays the bag body, it may be removed to reveal a concealed portion of the bag body without compromising the integrity of the bag container's outer wall.

In an important aspect of the invention, the removable section is sufficiently opaque to conceal hidden messages, game pieces and other indicia printed on the back of the removable section or on the concealed portion of the outer wall overlapped and covered by the removable section. The central and border seams in this embodiment are configured to prevent tampering with, and inhibit inadvertent viewing of, those hidden sections. The arrangement of seams and perforation lines further provide visual evidence of tampering or unauthorized disclosure of such hidden portions.

In another aspect of the invention, multiple plies of paper and foil, treated papers, paper and other products or other packaging materials are used to form a predimensioned product barrier wrap. A removable section that carries printed indicia or covers printed indicia on a lower ply is formed by seams or zones of inseparable barrier material, with adjacent, contiguous frangible zones formed by perforations disposed between the inseparable zones, and a gripping location on the removable section.

As further described below, the features and construction of the flexible containers, wrap and method of the invention provides an improved, cost effective and readily adaptable container, including bag containers for a variety of products and applications.

It should be understood that the above figures are not necessarily to scale. In certain instances, details of the actual structures which are not necessary for the understanding of the present invention have been omitted. It should also be understood that the invention is not necessarily limited to the particular embodiments discussed herein.

DETAILED DESCRIPTION OF A PREFERRED EMBODIMENT

Figure 1:
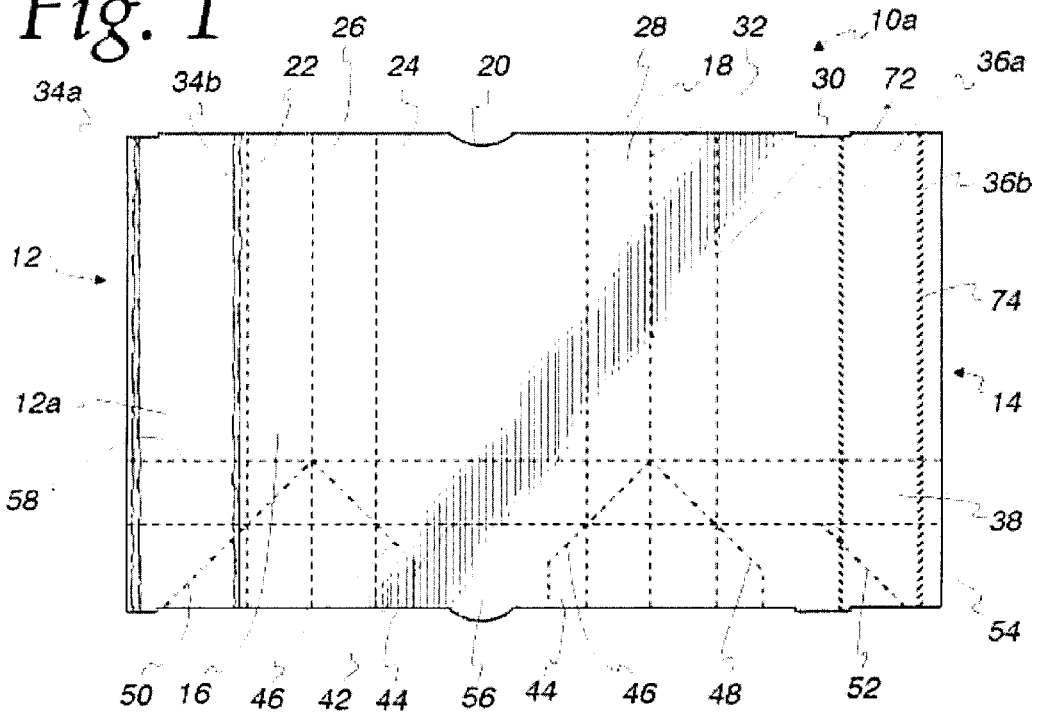
FIG. 1 is a plan view of a "blank" for an aspect of the invention in the form of a self-supporting, flat-bottomed flexible bag container.
Figure 2:
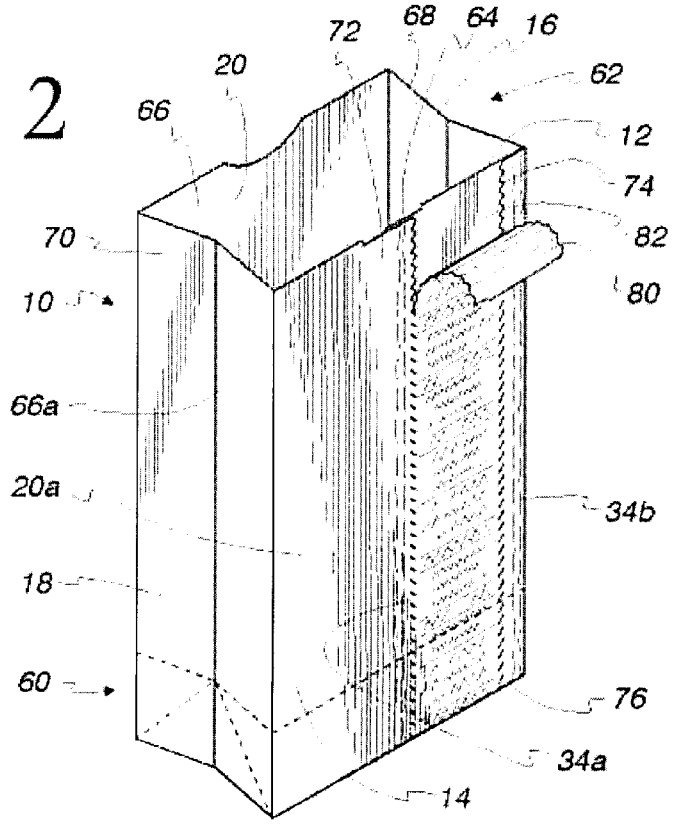
FIG. 2 is perspective view of the aspect of the invention converted from the "blank" of FIG. 1 into an open, self-supporting, flat-bottomed bag container depicting one aspect of a removable section of the invention partially separated from the bag.
Figure 3:
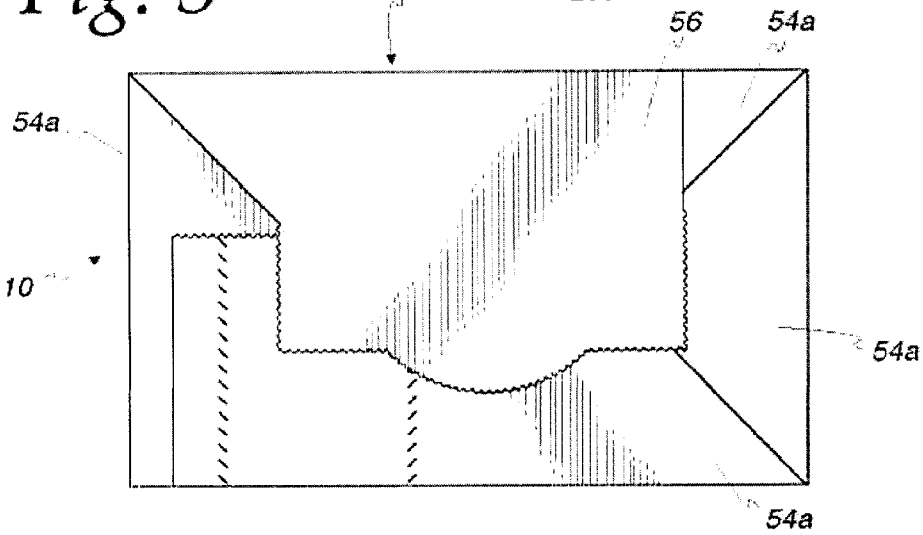
FIG. 3 is a bottom plan view of the aspect of the invention shown in FIG. 2.

One aspect of the flexible container of the invention is shown in FIGS. 1 to 3, which illustrate the use of the invention in a self-supporting, flat bottom bag 10. In that aspect, a blank for the flexible barrier material 10*a* is formed from a web of such materials drawn from a larger supply roll (not shown). The blank 10*a* may be formed using conventional blanking equipment capable of cutting predimensioned blanks from web material, providing such materials with predetermined fold lines and perforations, and applying coatings, such as inks, barrier coatings, adhesives or the like to all or selected portions of the blank.

The barrier material may be made from a variety of materials that are suitable for use in forming flexible containers, such as paper, treated paper, paper composites and laminated paper materials. In one aspect the blank 10*a* may be made of a single ply of waxed paper or resin impregnated paper material suitable for use as bakery bags, retail carry out bags or other such applications. In another aspect, the barrier material used to fabricate the blank may be a partially laminated material of moisture and heat retaining materials such as those discussed in Cortopassi et al., U.S. Pat. No. 5,335,996, which is incorporated herein by reference.

In another aspect, the barrier material may be formed from single ply papers of various compositions (including performance enhancing additives, fillers and coatings), paper and polymer laminates, paper and foil laminates and fully laminated, multi-ply paper products. In another aspect, polymeric materials and polymer composite materials of sufficient weight and thickness capable of folding and forming the bag containers and wraps mentioned below may be used for the blank 10*a*.

In an important aspect of the invention, the blank 10*a* is made of a paper barrier material with one or more surfaces that are adapted to receive printing inks, paints, decorative coloration or other indicia and patterns for marketing, communications, or for aesthetic purposes. Such designs, patterns and messages typically are applied using conventional printing, coating and screening, or other processes and equipment. In addition, depending on the application, the barrier material may be formed from multi-ply materials where one or more plies carry the messages, designs or other printed indicia, including materials that are printed on one ply and are overlaid with another transparent or semi-transparent ply.

The blank 10*a* dimensions may be varied depending on the barrier material and the expected size and capacity of the container. For example, in self-supporting, square bottom bag containers, the blank 10*a* may be sized to produce bag containers with the dimensions of conventional 4, 5, 6 and 8 pound or larger bags. The specific blank dimensions will depend on the expected end use of the container, specific functional and aesthetic design needs, and in some instances marketing needs applicable to the bag container.

In one aspect of the invention, the blank 10*a* is presized for forming a bag container with the dimensions of a 6 pound bag, with a blank thickness of about 0.005 inches (0.127 mm), a length of about 13.25 inches (33.66 cm) and a width of about 21.25 inches (54.0 cm). In many applications, several blanks are cut simultaneously from a single web of barrier material using a combination of conventional slitting knives, cutting blades or blanking dies. In other applications, it may be desirable to form the blank from a web or strip with dimensions corresponding to the width or length of the blank 10*a*. As shown in FIGS. 1 and 2, the perimeter of the blank 10*a* further may be provided with tabs and tab reliefs.

In the aspect of the invention shown in FIG. 1, the blank is provided with a series of predimensioned and prepositioned fold lines (indicated by dashed lines), typically formed by conventional scoring equipment utilized for making bag containers. As shown in FIG. 1, the fold lines define an inner panel 12, an outer panel 14, a first side panel 16, a second side panel 18 and a body panel 20. In the aspect shown in FIG. 1, one side of the inner panel 12 is defined by the scored fold line 22 as well as the left peripheral edge of the blank 10*a*.

The first side panel 16 is defined by the scored fold lines 22 and 24 and further is provided with a scored fold line 26 which defines a gusset in the first side panel 16. The gusset fold line 26 permits the formed bag to expand when opened and filled as mentioned below. The body panel 20 is generally defined by the scored fold lines 24 and 28. The fold lines 28 and 30 generally define the second side panel 18, which also is provided with the fold line 32 forming a gusset to allow expansion of the opened bag container 10.

The inner panel 12 is provided with a set of spaced, parallel adhesive lines 34*a* and 34*b*. As further discussed below, the adhesive lines 34*a* and 34*b* cooperate to secure overfolded portions of the barrier material in converting the blank 10*a* to the formed bag container 10. In this aspect for a 6 pound bag container, the adhesive lines 34*a* and 34*b* are about 0.0313 to 0.063 inches (0.795–1.54 cm) wide, are spaced about 2.5 inches (6.35 cm) apart and are disposed in a generally parallel relation extending generally the length of the inner panel section 12*a*. In this aspect, the adhesive may be thermosetting adhesives, cold bonding adhesives or other suitable adhesive materials.

The adhesives may be applied with a roller, brush, printing press plate, or another suitable applicator. Other adhesive patterns also may be used to form the adhesive lines 34*a* and 34*b*, such as intermittent, patterned or other adhesive configurations which are capable of providing a substantially inseparable seam and provide the functions mentioned below. Similarly, the spacing of the adhesive lines will determine the width of the removable section 80 and concealed section 82 discussed below.

In the aspect shown in FIG. 1, the outer panel 14 is provided with perforation lines 36*a* and 36*b*. The perforation lines 36*a* and 36*b* in this aspect are cuts about 2.0 inches (5.0 cm) wide disposed in a sawtooth pattern that penetrate the barrier material to a depth sufficient to form frangible zones in the barrier material generally along the line of perforations 36*a* and 36*b*. The perforation lines 36*a* and 36*b* are generally spaced in a parallel relation and extend generally the length of the outer panel 14. The perforation lines 36*a* and 36*b*, in addition, are spaced a sufficient distance apart to define a web section 38 between the perforation lines 36*a* and 36*b*. Other perforation patterns may also be such as chain style, circular perforations and other such patterns to form suitable frangible zones, depending on the barrier material and the desired application for the invention.

As further shown in FIG. 1, additional fold lines and cut lines (indicated by broken lines) are provided in this aspect to permit the formation of a generally planar bottom panel 40 which is shown in FIG. 3, when the bag container is folded and formed into the configuration shown in FIG. 2. The bottom fold lines include a first lateral fold line 42 defining a lower section 54 of the blank. The first lateral fold line 42 extends substantially the width of the blank and also defines the lower boundary of the inner panel 12, the outer panel 14, and the first 16 and second 18 side panels when the blank 10*a* is formed into the bag container 10 shown in FIGS. 2 and 3.

The lower section 54 of the blank 10*a* further is provided with cut lines 44 and first angularly fold lines 46, second angular fold line 48, third angular fold line 50 and fourth angular fold line 52. The cut lines 44 and angular fold lines 46, 48, 50 and 52 cooperate with lateral fold line 42 to allow the lower section 54 of the blank 10*a* to fold inwardly below the lateral fold line 42 to become the overlapping sections 54*a*. Those overlapping sections 54*a* provide a portion of the bottom panel 40 as shown in FIG. 3. The cut lines 44 further cooperate with the angular fold lines 46 to form the bottom flap 56 which overlies and is fixed with adhesive to the overlapping portions 54*a* to complete the bottom panel 40.

As shown in FIGS. 1 and 2, the angular fold lines 46, 48, 52 and 54 also cooperate with the second lateral fold line 58 spaced from, and extending generally parallel to, the first lateral fold line 42, substantially across the width of the blank 10*a*. As shown in FIG. 2, the side panel gusset lines 26 and 32, the second lateral fold line 58, and the angular fold lines 46, 48 and 50 are positioned to cooperate in permitting the lower portion 60 of the formed bag container 10 to collapse into a flattened state. In that position, the gusset lines 26 and 32, and angular fold lines 46, 48 and 50 permit the first 16 and second 18 side panels to bi-fold and move inwardly between the body panel 20 and the inner 12 and outer 14 panels. The second lateral fold line 58, and the angular fold lines 46, 48 and 50 further allow the bag bottom portion 60 to fold inwardly along the second lateral portion to a substantially flat position.

When the bag container 10 is restored to the open position shown in FIG. 2, the gusset lines 26 and 32, and angular fold lines 46, 48 and 50 and bottom panel 40 reversibly fold in an outward direction to expand the bag container 10. In this configuration, the bag container 10, has a sufficiently self-supporting structure to maintain the bag container 10 in the expanded position without substantial assistance from the user.

In other aspects of the invention, additional or alternative fold lines cut lines and gusset line patterns may be used. Moreover, the specific dimensions, depth of scoring and shape of the sections formed the gusset lines, fold lines and cut lines in alternative aspects of the invention may be varied to address the structural, marketing and operational needs of other, specific applications for a self-supporting, easily opened bag container 10.

As mentioned above, the blank 10*a* is folded and formed into the bag container 10 shown in FIG. 2 using conventional bag container manufacturing equipment. In that forming procedure, the blank 10*a* is formed into a generally cylindrical outer barrier wall 62 and the outer panel 14 is folded over the inner panel 12 to form a second body panel 20*a*, opposite the first body panel 20. The bottom panel 56 is formed as previously mentioned to provide the outer wall 62 with a first closed end of the bag container 10. Opposite the bottom panel 56, the peripheral edges 66 and 66*a* of the body panels 20 and 20*a*, respectively, and the peripheral edges 68 and 70 of the side panels 16 and 18, respectively, define the open end of the bag container 10. In an important aspect, the barrier material is sufficiently flexible to allow a user to reversibly close the bag container 10 by folding over the peripheral edges 66, 66*a*, 68 and 70 and enclose the contents of the bag 10.

As shown in FIGS. 1 and 2, the outer panel 14 is positioned to overlie at least a portion of the inner panel 12. A first receiving surface 72 on the outer panel 14 is pressed against and adhered to the first adhesive line 34*a* to form a central seam 64 adjacent to and contiguous to the perforation line 36*a*. The central seam 64 extends generally the length of the second body panel 20*a*, and may in some aspects extend into the bottom panel 56. The outer panel 14 and inner panel 12 along the central seam 64 are substantially inseparable and serve to complete the barrier wall 62, as well as to permit the separation of the removable section 80 from the second body panel 20*a* without interfering with integrity of the barrier wall 62 as mentioned below.

As shown in FIGS. 1 and 2, an outer edge receiving surface 74 of the outer panel 14 similarly is positioned to overlie, press against, and adhere to the second glue line 34*b* on the inner panel 12. The second glue line 34*b* and outer edge receiving surface 74 form a second, border seam 76 adjacent to and contiguous to the second perforation line 36. In some aspects, the border seam 76 may extend into the bottom panel 54. As with the central seam 64, the inner panel 12 and outer panel 14 are substantially inseparable at and along the border seam 76. The inner panel 12 and outer panel 14 further are positioned so that the perforation lines 36*a* and 36*b* are disposed between the central 64 and border 76 seams.

As a result of the overfolded positioning of the outer panel 14 and inner panel 12, the web portion 38 between the perforation lines 36*a* and 36*b* provides a removable section 80 in the outer panel 14 of the formed bag container 10. The removable section 80 overlies a concealed section 82 of the inner panel 12 which, in this aspect, is not adhered to the removable section 80. The removable section 80 and the concealed section 82 generally extend the length of the second body panel 20*a*, although in some applications, the sections 80 and 82 may extend a shorter distance or may extend into the bottom panel 40.

The perforation lines 36*a* and 36*b* also typically are disposed adjacent to and contiguous with the central seam 64 and border seam 76 to maximize the undisrupted surface of the removable section 80 and concealed section 82. In other configurations, the perforation lines 36*a* and 36*b* may be located in closer proximity to each other to provide a reduced removable section. In other aspects, additional perforations and/or glue lines may be added to the inner panel 12 and outer panel 14 to form multi-part removable sections and/or concealed sections. For example, an additional adhesive line may be added between and parallel to the adhesive lines 34*a* of 34*b*, and may be coupled with additional perforation lines to form the web portion 38 into two removable sections with generally inseparable barriers. In addition, perforation lines may be added to the outer panel 14, without additional adhesive lines to subdivide the web 38.

As illustrated in FIG. 2, the removable section 80 may be gripped near the peripheral edge 66*a* of the second body panel 20*a* so that it can be peeled away from the concealed section 82. As previously mentioned, the perforation lines 36*a* and 36*b* form frangible zones permitting the barrier material to separate or tear in those frangible zone as the removable section 80 is peeled away from the concealed section 82. The extent of barrier material separation in the frangible zones formed by the perforation lines 36*a* and 36*b* is controlled by, and to a certain extent predetermined by, the pattern, depth and configuration of the perforation lines 36*a* and 36*b*, and further by the inseparable central 64 and border seams 76. The seams 64 and 76, in particular, reduce the potential for the creation of holes, tears or other weakened area that might compromise the integral, structural integrity of the outer barrier wall 62 of the bag container 10.

The removable section 80 may be torn or separated along the lower peripheral edge of the second body panel 20*a* formed by the first lateral fold line 44. Typically, the barrier material is sufficiently weakened along that fold line 44 by the scoring forming the line 44, as well as the folding of the barrier material along that fold line, to permit the separation of the removable section 80 bag container 10 without jeopardizing the integral, structural integrity of the barrier wall 62.

As shown in FIG. 1, the outer surface of the removable section 80 is printable and coatable with various messages, information and marketing indicia. Examples of uses for the removable strip 80 include uses such as coupon strips, notes or order strips, menu strips or other informational strips. Because the side panels 12 and 14, the body panels 20 and 20*a*, and the bottom panel 40 do not include loose flaps, substantial unattached sections or other easily separated edges or portions, the bag container is particularly well suited for applications requiring compact, integral flexible containers for use in high speed handling machines. This includes automated, high speed, insertion equipment and interleaving equipment commonly used to place advertisements, circular and promotional pieces into a newspaper or magazine.

Figure 4:
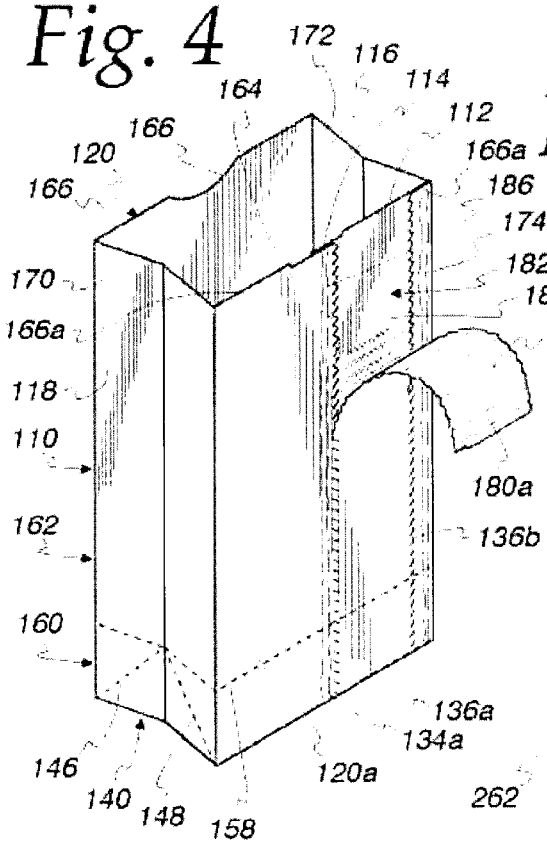
FIG. 4 is a perspective view of another aspect of the invention in the form of an open, self-supporting bag container utilizing a substantially opaque, removable section covering hidden printed indicia, where the removable section is partially separated from the bag container to expose the printed indicia.
Figure 5:
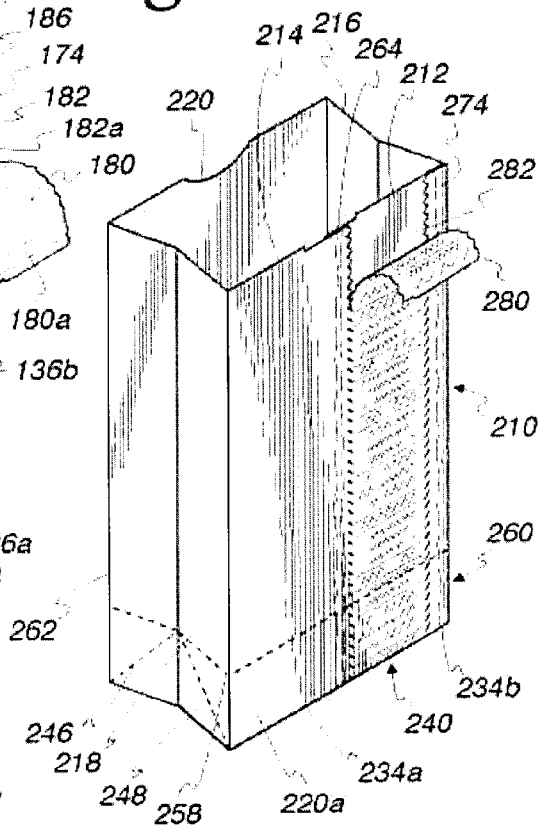
FIG. 5 is a perspective view of another aspect of the invention in the form of an open, self-opening bag container utilizing a removable section with printed indicia on the outer surface of the removable section and hidden, printed indicia on the reverse, inner surface of the removable section, where the removable section is partially separated from the bag container to expose the hidden, printed indicia.

Other aspects of the invention are shown in FIGS. 4 and 5. The bag container of FIG. 4 is a self-standing, square bottom bag container 110 formed of a barrier wall 162 and a closed bottom panel 140. The wall 162 is formed of side panels 116 and 118, and body panels 120 and 120*a*, with reversibly foldable peripheral portions 166, 166*a*, 170 and 172 defining an opening to the interior of the container 110, opposite the bottom panel 140. The body panel 120*a* is formed by overlapping the outer panel 114 and inner panel. The bottom portion 160 of the bag container 110 is provided with lateral fold line 158 and angular fold lines 146, 148, and 150 (not shown) permitting the lower portion 160 to be reversibly collapsed so that the bag container 110 may be stored in a flattened position.

An adhesive line 134*a* forms a center seam 164, attaching the inner panel 112 to the outer panel 114 and rendering those panels 112 and 114 generally inseparable along the central seam 164. The adhesive line 134*b* forms the border seam 176 attaching the peripheral edge of the outer panel 114 to the inner panel 112. The barrier materials of the inner panel 112 and outer panel 114 are generally inseparable at the center 164 and border 176 seams. The seams 164 and 176 further define a removable section 180 in the outer panel 114 and a concealed section 182 on the inner panel 112.

The outer panel 114, in addition, is provided with perforation lines 136*a* and 136*b* adjacent to, between, and contiguous with the seams 164 and 176. The frangible zones provided by the perforation lines 136*a* and 136*b* extend substantially the length of the second body panel 120*a*. The dimensions and spacing of the adhesive lines 134*a* and 134*b* and the perforation lines 136*a* and 136*b* may be as indicated above for the aspect shown in FIGS. 1 and 2.

As in the bag container 10, the removable section 180 of the bag container 110 may be peeled away from the concealed section 182. The removable section 180 separates from the second body panel 120*a* at the frangible zones formed by the perforation lines 136*a* and 136*b*. The extent of material separation in the frangible zones is limited by the configuration of the perforation lines 136*a* and 136*b*, and by the placement of the inseparable seams 164 and 176 to prevent compromising the structural integrity of the outer wall 162. The removable section 180 also may be separated along the lower peripheral edge of the second body panel 120*a*, along the fold line forming that border.

In FIG. 4, the removable section 180 and the concealed section 182 are rendered substantially opaque due to the nature and contents of the barrier material, through the application of printing or overcoatings or through other methods of rendering all or a portion of the removable section 180 substantially light impermeable. For example, in such aspects, the barrier material contains sufficient fillers and additives to prevent the passage of a significant amount of light through the removable 180 and concealed 182 sections. In another aspect, the barrier material is of a multi-ply construction, with one ply of a light blocking material such as foil, which also may lend some degree of heat retention properties to the bag container 110. In another aspect, the adjacent surface of the removable section 180*a* and the concealed section 182*a* may be treated with a light blocking coatings inks, paints and other such materials. In yet another aspect, a masking pattern of a printed design is applied to the inner surface 180*a* and the outer surface of the removable section 180, as well as to the concealed section 182 to prevent one from looking through the removable section 180 and concealed section 182.

The surface 182*a* of the concealed section 182 or the inner surface 180*a* of the removable section 180 may be printed with marketing, informative or other printed indica. Such indicia is revealed only when the removable section 180 is separated from the bag container 110. Such features are of particular value when using the bag container 110 for marketing purposes, such as for a contest or a discount program where the hints, game pieces, or awards are hidden and only are revealed after the bag containers are dispensed to their end users or at a time specified by the rules and conditions for the marketing activities. The bag container 110 therefore eliminates the inadvertent disclosure of such printed indicia by covering the indica with the removable section 180, and provides an easily perceived check on the integrity of the removable section 180. Efforts to tamper with the removable section will be revealed by the full or partial separation of the section 180, typically at the perforation lines 136*a* and 136*b*.

For further security, a line of a releasable adhesive may be employed, such as the optional adhesive line 186, to temporarily hold or "tack" in place all or part of the, free, peripheral portion of the removable section 180. This additional releasable adhesive line 186 may be used to prevent the manipulation of the bag 10 walls to reveal concealed information under the removable section 180.

The exterior of the bag container 110 also may be printed with messages, information and marketing indicia may be applied to the bag surface. As mentioned above, the removable strip may be used for coupon strips, notes or order strips, menu strips or other informational strips. Furthermore, this aspect does not include loose flaps, substantial unattached sections or other easily separated edges or portions. Thus, the bag container 110 also is particularly well suited for use in high speed handling machines, including insertion equipment and interleaving equipment.

Another aspect of the invention is shown in FIG. 5 as a self-supporting, square bottom bag container 210 formed of a predimensioned outer wall 262 and a closed bottom panel 240. The outer wall 262 is formed of side panels 216 and 218, and body panels 220 and 220*a*. The body panel 220*a* is formed by overlapping outer panel 214 and an inner panel 212. The bottom portion 260 of the bag container 210 is provided with a lateral fold line 258 and angular fold lines 246 and 248, and 250 (not shown) permitting the lower portion 260 to be collapsed so that the bag container 210 may be stored in a flattened position.

An adhesive line 234*a* forms a center seam 264, and adhesive line 234*b* forms border seam 276 joining portions of the inner panel 212 and outer panel 214 in generally inseparable zones along the adhesive lines 234*a* and 234*b*. The seams 264 and 276 further define a web of barrier material between them forming a removable section 280 in the outer panel 214, and a web of barrier material forming a concealed section 282 on the inner panel 212. The outer panel 214, in addition, is provided with perforation lines 236*a* and 236*b* disposed between, adjacent to and contiguous with the seams 264 and 274. The perforation lines 236*a* and 236*b* form frangible zones extending substantially the length of the second body panel 220*a*. The dimensions and spacing of the adhesive lines 234*a* and 234*b*, and the perforation lines 236*a* and 236*b* may be as described above for the aspect shown in FIGS. 1 and 2.

The removable section 280 of the bag container 210 may be peeled away from the concealed section 282 and separates from the second body panel 220*a* at the frangible zones formed by the perforation lines 236*a* and 236*b*. The extent of material separation in the frangible zones is limited by the configuration of the perforation lines 236*a* and 236*b*, and by the inseparable seams 264 and 276 to maintain the structural integrity of the outer wall 262. The removable section 280 in the bag container 210 may be separated along the lower peripheral edge of the second body panel 220*a*.

In the aspect of the bag container 210 shown in FIG. 5, both the outer surface of the removable section 280 and the inner surface 280*a* are printed with messages, information, marketing indicia, or other designs and ornamentation. In this aspect, the barrier material preferably is sufficiently opaque to prevent the printing or other indicia on the inner surface 280*a* to bleed or show through to the outer surface of the removable section 280. The additional printable surface 280*a* provides further opportunities to display marketing messages, coupon strips, notes or order strips, menu strips or other informational strips. The additional surfaces may be used as alternative locations for hidden messages, game pieces or the like as discussed above in connection with the bag container 110 shown in FIG. 4.

The side panels 212 and 214, the body panels 220 and 220*a*, and the bottom panel 240 of the bag container 220 do not include loose flaps, substantial unattached sections or other easily separated edges or portions. Thus, this bag container 210 also is particularly well suited for use in high speed handling machines, including insertion equipment and interleaving equipment commonly used to place advertisements, circular and promotional pieces into a newspaper or magazine.

Figure 6:
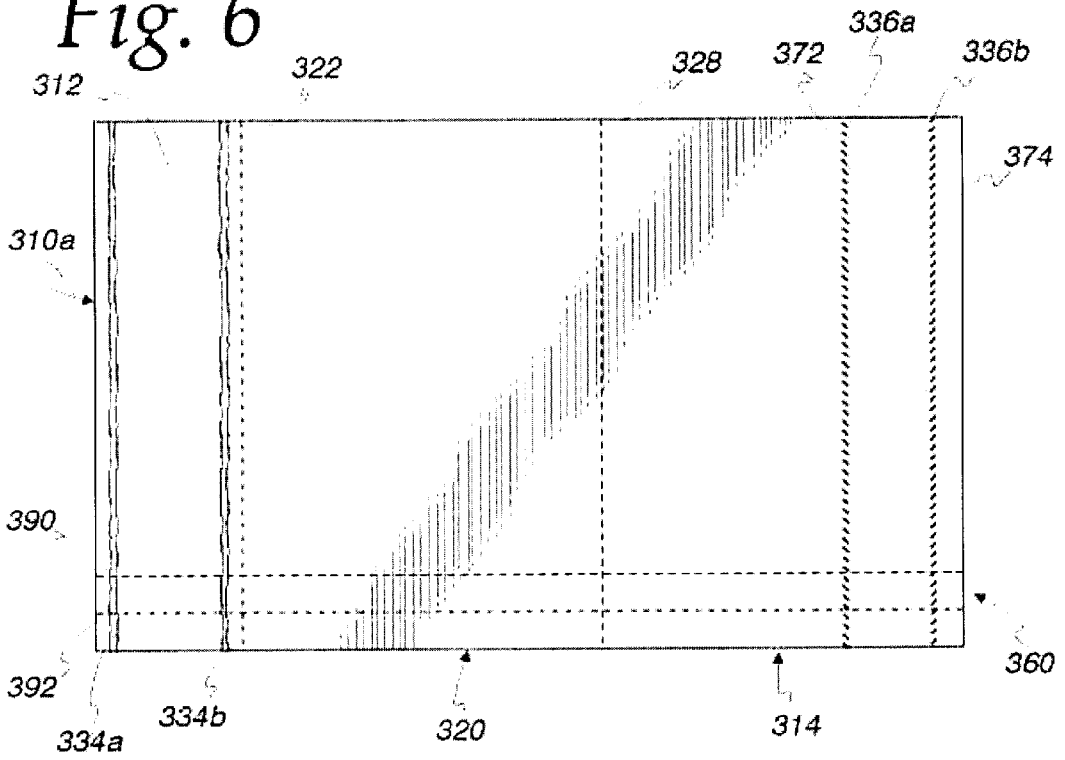
FIG. 6 is a "blank" for another aspect of the invention in the form of a pinch-bottomed flexible bag container.
Figure 7:
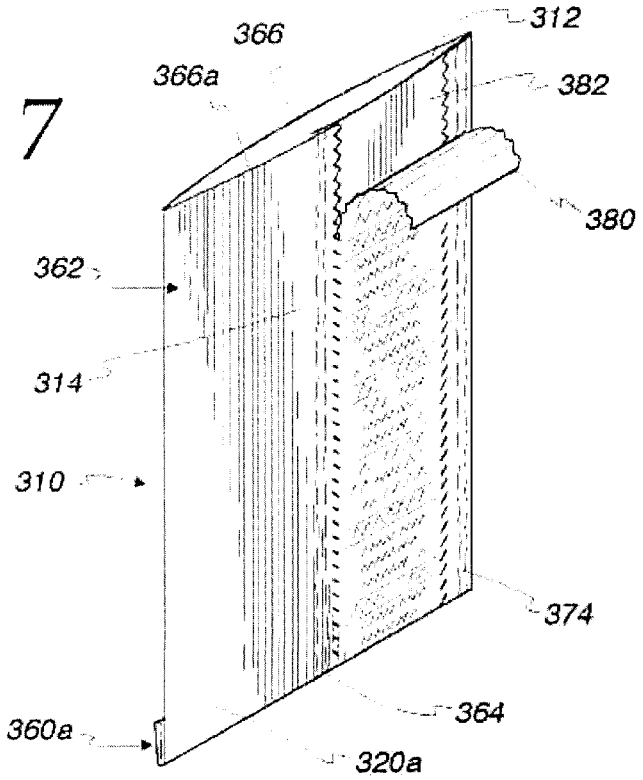
FIG. 7 is a perspective view of the aspect of the converted blank shown in FIG. 6 in the form of an open pinch-bottom flexible bag container depicting one aspect of a removable section of the invention partially separated from the bag.

Another aspect for a pinch or rolled bottom bag 310 is shown in FIGS. 6 and 7. The blank 310*a* for this aspect is shown in FIG. 5 and is formed of the barrier materials discussed above in connection with the bag containers 10, 110 and 210. The blank, for example, may be made from barrier materials about 0.005 inches (0.127 mm) thick and with outer dimensions sized to make bag containers as small as about 26.25 inches (54.0 cm) inches wide to about 10 inches (25.4 cm) wide. An inner panel 312, an outer panel 314 and a body panel 320 are formed from the blank 310*a*. In the aspect shown in FIG. 4, the inner panel 312 is defined by the scored fold line 322, which also forms a general boundary between the inner panel 312 and the body panel 320. The body panel 320 is further generally defined by the fold line 328, which also defines, in part, the outer panel 314.

The inner panel 312 includes a set of adhesive lines 334*a* and 334*b* that are disposed in a generally parallel, spaced relation. As mentioned above, other adhesive patterns also may be used as well. In this aspect, the outer panel 314 further is provided with a perforation lines 336*a* and 336*b* of the form and dimensions discussed above with respect to the blank 10 shown in FIG. 1 above. The perforation lines 336*a* and 336*b* are spaced in a generally parallel relation and extend substantially the length of the blank 310*a*, although other perforation patterns also may be used as mentioned above. The spacing and dimensions of the adhesive lines 324*a* and 324*b* and the perforation lines 326*a* and 326*b* may be as indicated above for the aspect shown in FIGS. 1 and 2.

As further shown in FIGS. 6 and 7, fold lines 390 and 392 are provided in this aspect to permit the formation of a rolled and pinched bottom for the bag container 310. As shown in FIG. 7, the fold lines 322 and 328 cooperate to allow the folding, the application of adhesive to the folded section and the sealings of the bottom of the bag. As a result, bag container 310 may be stored in a compact, flattened condition.

As mentioned above, the blank 310*a* is folded and formed into the bag container 310 shown in FIG. 7 using conventional bag container manufacturing equipment. In that forming procedure, the blank 310*a* is formed into an outer wall 362 by folding the outer panel 314 folded over the inner panel 312 to form a second body panel 320*a,* opposite the first body panel 320. The bottom portion 360 of the blank 310*a* is folded along the lateral fold lines 390 and 392, and is glued in place to form the bottom 360*a* of the bag container 310. The opposite peripheral edges 366 and 366*a* edges of the body panels 320 and 320*a,* respectively, define an open, foldable end of the bag container 310.

In forming the bag container 310, the outer panel 314 is positioned to overlie at least a portion of the inner panel 312. A first receiving surface 372 on the outer panel 314 is pressed against and adhered to the first adhesive line 334*a* to form a central seam 364 adjacent and contiguous to the perforation line 336*a.* The central seam 364 extends substantially the length of the second body panel 320*a,* and may in some aspects extend into the bottom section 360*a.* Similarly, an outer edge receiving surface 374 of the outer panel 314 is positioned to overlie, press against, and adhere to the second adhesive line 334*b* on the inner panel. The second adhesive line 334*b* and outer edge receiving surface 374 forms a second border seam 376 adjacent to and contiguous with the second perforation line 336*b.* In some aspects, the border seam 374 also extends into the bottom section 360*a.*

The inner panel 312 and the outer panel 314 are substantially inseparable along the central seam 364 and border seam 376. A web of the barrier material forming a removable section 380 in the outer panel 314 is further defined by the central seam 364 and border seam 376. The removable section 380 overlies a concealed section 382 of the inner panel 312. In one important aspect, the removable section 380 is not adhered to the concealed section 382 and generally extends the length of the second body panel 320*a.* Similarly, in that aspect, the concealed section 382 also extends generally the length of the second body panel 320*a.* The inner panel 312 and outer panel 314 also are positioned so that the perforation lines 336*a* and 336*b* are disposed between the central 364 and border 376 seams. In the formed bag container 310, the perforation lines 336*a* and 336*b* preferably are disposed adjacent to and contiguous with the central 364 and border 376 seams to maximize the undisrupted surface of the removable section 380 and concealed section 382.

As illustrated in FIG. 7, the removable section 380 may be gripped near the peripheral edge 366*a* of the second body panel 320*a* and may be peeled away from the concealed section 382. The perforation lines 336*a* and 336*b* form frangible zones permitting the barrier material separate or tear in the frangible zones as the removable section 380 is peeled away from the concealed section 382. The extent of barrier material separation in the frangible zones formed by the perforation lines 336*a* and 336*b* is controlled by the perforation lines 336*a* and 336*b,* and the inseparable central 364 and border seams 374 to substantially preserve the structural integrity of the outer wall 362 of the bag container 310.

The removable section 380, in addition, may be separated along the lower peripheral edge of the second body panel 320*a,* formed by the first lateral fold line 390. As mentioned above, typically the barrier materials is sufficiently weakened along such a fold line to allow separation of the removable section 380.

As shown in FIG. 7, the outer surface of the removable section 380 is printable and various messages, information and marketing indicia as mentioned above in connection with FIGS. 1 to 5. Furthermore, as in the other aspects discussed above the side panels 312 and 314, and the body panels 320 and 320*a* do not include loose flaps, substantial unattached sections or other easily separated edges or portions. As a result, when in the collapsed position, the bag container is particularly well suited for applications requiring high speed handling machines, including insertion equipment and interleaving equipment commonly used to place advertisements, circular and promotional pieces into a newspaper or magazine.

Figure 8:
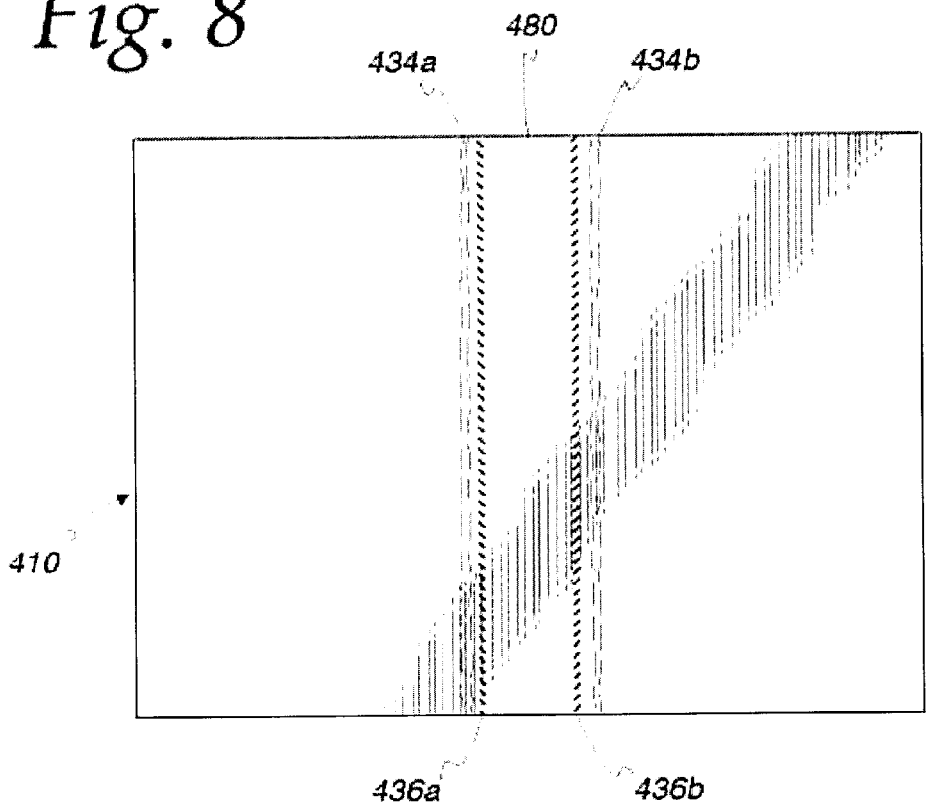
FIG. 8 is a plan view of one aspect of the invention in the form of a sheet of barrier material provided as a product wrap.
Figure 9:
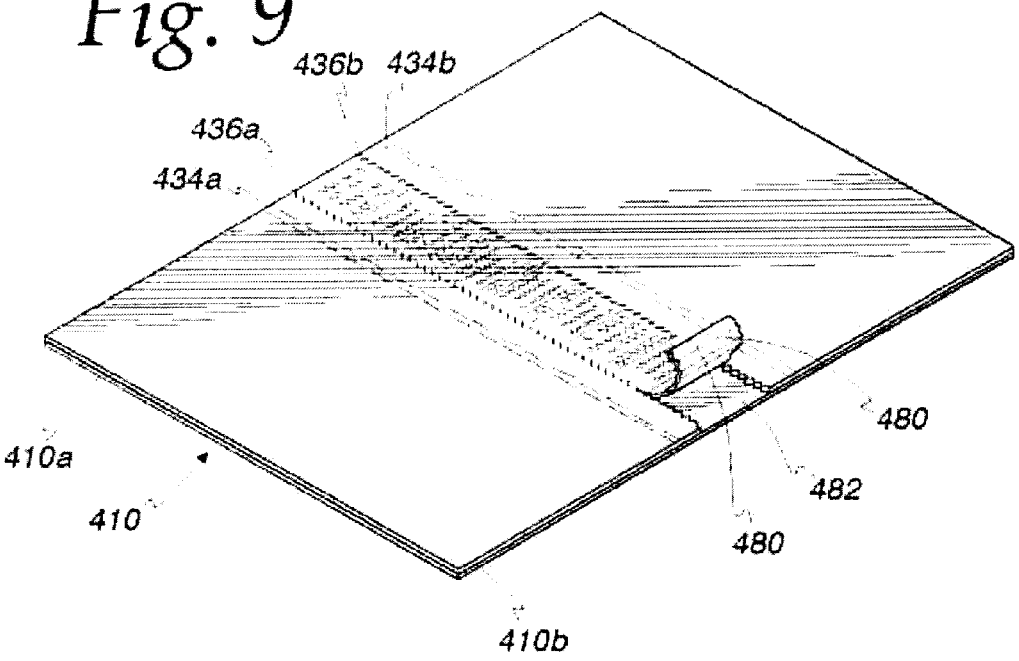
FIG. 9 is a plan view of the aspect of the invention in the form of a wrap depicting a removable section partially separated from the bag.

Another aspect of the invention is for a wrap sheet or web 410 for food or other products and is shown in FIGS. 8 and 9. The blank 410 for this aspect is formed of multi-ply barrier materials with at least an upper layer 410*a* and a lower layer 410*b.* The thickness dimensions of the wrap 410 are predetermined depending on the expected use for the products. For example, the wrap blank 410 may be 0.005 inches (0.127 mm) thick with a width of about 12 inches (30.48 cm) and a length of about 14 inches (35.56 cm). The wrap sections may be precut to specific dimensions, may be supplied pre-sized on perforated rolls or webs, or may be supplied on a continuous web with a predetermined width for applications where the wrap lengths are variable, as well as in other forms commonly used for wraps of various types.

The multi-layer barrier material of the wrap 410 may be made of a variety of constructions, including plies or layers that are fully or partially fixed around the periphery wrap 410, aspects that are of a honey combed laminated materials such as that discussed in the Cortopassi patent mentioned above, or other multi-layer composites. Alternatively, two or more webs of barrier materials may be brought together to form the multi-layer construction of the wrap 410, as part of the wrap construction. In addition, the wrap 410 plies may be of different materials with different properties, such as foils and papers, polymers, papers and foils, etc. Further wrap materials are discussed above in connection with the bag containers of FIGS. 1 to 7.

As shown in FIGS. 8 and 9, a set of spaced, parallel adhesive lines 434*a* and 434*b* with dimensions as discussed above with respect to the aspect shown in FIG. 1. The adhesive lines 434*a* and 434*b* are disposed in a generally parallel relation between the plies, to form zones where the plies are substantially inseparable. The spacing of the adhesive lines 434*a* and 434*b* may be determined by the desired size of the removable section 480 and concealed section 482 discussed below. In one example, the adhesive lines were spaced about 2.0 inches (5.08 cm) apart. The portion of the ply between the adhesive lines 434*a* and 434*b* is substantially free of adhesive and provides a separable section 480 and a concealed section 482. The adhesive lines 434*a* and 434*b* extend generally continuously the length of the blank 410*a.* Other adhesive patterns may be used to form the adhesive lines 434*a* and 434*b,* such as intermittent, patterned or other adhesive, as mentioned above.

In this aspect, the upper ply 410*b* is provided with a perforation lines 436*a* and 436*b* of the form and dimensions discussed above with respect to the aspect shown in FIG. 1. The perforation lines 436*a* and 436*b* are generally spaced in a parallel relation and extend generally the length of the blank 410*a.* Furthermore, the perforation lines 436*a* and 436*b* are disposed between the central adhesive lines 434*a* and 434*b,* preferably adjacent to and contiguous with adhesive lines to maximize the undisrupted surface of the removable section 380 and concealed sections 382.

As illustrated in FIG. 9, the removable section 480 may be gripped near a peripheral edge of the wrap 410 and may be peeled away from the concealed section 482. The perforation lines 436*a* and 436*b* form frangible zones permitting the barrier material separate or tear in those frangible zones as the removable section 480 is peeled away from the concealed section 482. The extent of barrier material separation in the frangible zones is controlled by the perforation lines 436*a* and 436*b,* and the inseparable zones formed by the adhesive lines 434*a* and 434*b* to preserve the structural integrity of the lower ply 410*a*.

As shown in FIG. 9, the outer surface of the removable section 480 is printable and various messages, information and marketing indicia may be applied to the outer surface of the removable section 480, as well as to the inner surface of the removable section 480*a,* and the concealed surface 482. This aspect also may be used to provide wraps with opaque removable sections 480 and concealed 482 sections for use in hidden coupon, discount and game piece applications such as discussed above in connection with FIGS. 1–5 above.

In this aspect, a wrap 410 may be provided with no loose flaps, substantial unattached sections or other easily separated edges or portions. The wrap 410 is particularly well suited for applications requiring high speed handling machines, and in applications where a space-conserving stacks or packages of pre-cut pieces of the wrap 410 are desirable. In addition, the wrap 410 may be folded using conventional folding equipment for use in self-starting dispensing boxes, such as in fast food or retail food applications.

While the invention has been described by reference to certain specific descriptive and examples which illustrate preferred materials and conditions, it is understood that the invention is not limited thereto. Rather all alternatives, modifications and equivalents within the scope of the invention so described and considered to be within the scope of the appended claims.

What is claimed is:

1. A container of a flexible, foldable barrier material comprising:

a predimensioned outer wall with first peripheral borders in folded relation along fold lines defining and forming a closed end of the container and second peripheral borders defining an opening to the interior of the container, the second peripheral borders reversibly foldable from a first open position providing access to the interior of the container to a second closed position;

at least one multi-ply panel integral to the outer wall formed of at least one inner ply and at least one outer ply disposed to cover the inner ply; the panel having a width and at least two opposing borders, the panel extending generally from the first peripheral borders of the outer wall to the second peripheral borders of the outer wall;

the inner ply and outer ply substantially inseparable fixed together in at least two generally parallel, spaced zones defining the borders of the panel, the inner ply and the outer ply in a generally separable relation between the panel borders; and the outer ply provided with a gripping surface and at least two spaced frangible lines disposed between the panel borders and at least one frangible zone disposed along the outer ply and extending between the panel borders, the frangible zone spaced from the fold lines of the closed end of the container effective to permit the removal of the outer ply from the panel without opening the closed end of the container to expose the panel inner ply when the panel gripping surface is gasped and the outer ply is pulled away from the panel, and the frangible lines and frangible zone effective to resist disruption of the panel construction during handling and operation of the container.

2. The container of claim 1 wherein at least one portion of the inner ply and the outer ply extend to the first peripheral borders and forms a portion of the closed end of the container and the inner ply is provided with a surface disposed to receive printed indicia thereupon; the outer ply is formed of a substantially light impervious material disposed to cover the inner ply preventing the observation of the indicia printed thereon until the outer ply is removed from the panel.

3. The container of claim 2 wherein the outer ply of the removable section is provided with a first printable, upper surface and a second printable lower surface; the outer ply positioned to display the upper surface and to conceal the inner surface until the outer ply is removed form the panel.

4. The container of claim 3 wherein the outer wall includes at least a first side and a second side, and the panel is formed on the second side by overlapping a first portion of the outer wall with a sealing edge over a second portion of the outer wall and sealing the first portion to the second portion along the sealing edge, and the sealing edge forms one of the borders of the multiply panel and at least one of the frangible lines is contiguous with the sealing edge of the first portion of the outer wall, where at least one portion of the overlapping wall forms the removable outer ply and at least one portion of the overlapping wall forms the panel inner ply.

5. The container of claim 4 wherein the inseparable zones are formed by adhesive materials disposed between the overlapping portions of the outer wall.

6. The container of claim 5 wherein the frangible lines are formed from perforations penetrating the outer ply of the separable panel section without penetrating the inner ply of the panel section.

7. The container of claim 6 wherein the panel extends generally from the closed end of the container to the second peripheral border.

8. A method for forming a container of flexible, foldable barrier material comprising the following steps:

providing a predimensioned blank of the flexible barrier material;

folding the blank into a container with an outer wall with first peripheral borders in folded relation along fold lines defining and forming a closed first end of the container and folding the blank into foldable peripheral borders of the blank defining an opening to the interior of the container in a first open position and substantially closing the container in a second, folded position;

folding the blank into at least one multi-ply panel on the container outer wall with an inner ply integral to the outer wall and at least one outer ply disposed in a generally separable relation with the inner ply covering the inner ply, the panel having a width and at least two opposing borders, and the panel extending from the first peripheral borders to the second peripheral borders;

providing the inner and out plies with at least two, generally parallel, spaced substantially inseparable zones defining borders of the panel and generally extending the length of the inseparable zones; and a frangible zone spaced from the fold lines of the closed end of the container.

providing a gripping surface on the outer ply and at least two frangible zones between the panel borders effective to resist separation of the outer ply from the panel during handling and use of the container and to reduce the outer ply's resistance to separation from the panel when the gripping surface is gasped and the outer ply is pulled away from the panel to expose the panel inner ply; and providing at least one frangible zone spaced from the fold lines of the closed end of the container effective to permit the removal of the outer ply from the panel without opening the closed end of the container.

9. The method of claim 8 wherein the outer ply is formed of a light impermeable material and the inner ply is formed of a surface disposed to receive printed indicia thereupon, the outer ply positioned to cover the inner ply to prevent observation of the indicia until the outer ply is removed from the panel.

10. The method of claim 9 wherein the panel outer ply is formed of a printable material provided with a first upper surface and a second lower surface; and the outer ply disposed relative to the inner ply to display the upper surface of the upper panel and to conceal the inner surface until the outer ply is removed form the outer wall.

11. The method of claim 10 wherein the panel is folded by overlapping one portion of the outer wall over another portion of the outer wall, where at least one portion of the overlapping walls forms a removable outer ply and at least one portion of the overlapping wall forms the inner ply integral with the outer wall.

12. The method of claim 11 wherein the zones of inseparable barrier material are formed by zones of adhesive materials disposed between the overlapping portions of the outer wall.

13. The method of claim 12 wherein the frangible zones are formed of lines of perforations penetrating the outer ply of the separable panel section without penetrating the inner ply of the separable panel section.

* * * * *